United States Patent [19]

Lawrence et al.

[11] Patent Number: 4,510,744

[45] Date of Patent: Apr. 16, 1985

[54] APPARATUS FOR FALSE TWISTING YARN

[75] Inventors: Christopher J. Lawrence, Macclesfield; Philip M. Wilkinson, Cheadle; Colin Atkinson, Macclesfield, all of England

[73] Assignee: Rieter-Scragg Limited, Cheshire, England

[21] Appl. No.: 500,002

[22] Filed: Jun. 1, 1983

[30] Foreign Application Priority Data

Jun. 1, 1982 [GB] United Kingdom ..... 8215876

[51] Int. Cl.[3] ..... D02G 1/08; D01H 15/00

[52] U.S. Cl. ..... 57/280; 57/339; 57/340

[58] Field of Search ..... 57/279, 280, 339, 340, 57/348

[56] References Cited

U.S. PATENT DOCUMENTS 3,762,149 10/1973 Raschle ..... 57/339
3,911,661 10/1975 Naylok ..... 57/280 X
4,149,366 4/1979 Bass et al. ..... 57/280
4,226,080 10/1980 Bieber et al. ..... 57/280 X
4,235,071 11/1980 Dillon ..... 57/280
4,412,412 11/1983 Paul et al. ..... 57/280

*Primary Examiner*—John Petrakes
*Attorney, Agent, or Firm*—Oblon, Fisher, Spivak, McClelland & Maier

[57] ABSTRACT

For false twisting apparatus (21) of the kind comprising three rotatable parallel shafts (10,11,12) arranged at the apices of a triangle and having a plurality of parallel discs (14) on each shaft (12) inter-digitating with the discs (14) on the other two shafts (10,11), a threading device (13) is provided allowing sequential threading of a yarn into the apparatus (21). The threading device (13) comprises a body (30) on which tines (40 to 44) are slidably mounted in spaced disposition longitudinally of the body (30) and which can be pushed sequentially into the spaces between consecutive discs (14) on two stacks (10,11) as separated by the discs (14) on the other shaft (12).

25 Claims, 4 Drawing Figures

APPARATUS FOR FALSE TWISTING YARN

This invention relates to apparatus for false twisting yarn of the kind (hereinafter termed of the kind referred to) comprising three rotatable parallel shafts arranged at the apices of an equilateral triangle, a plurality of parallel coaxial discs forming a disc stack carried by each shaft, the discs being arranged on the shafts so as to create a series of discs arranged on a helix around a line parallel to the shafts and centrally thereof, and relates more particularly to a device for threading yarn into such apparatus.

Apparatus of the kind referred to has become well known in the last decade and one known example comprises an improved arrangement utilising discs of axial thickness substantially greater than previously or conventionally employed.

Threading of apparatus of the kind referred to has been a problem, but has been largely overcome on conventional such apparatus by use of a threading device including a plurality of arms. The device is movable from a first position, wherein the arms lie outside the extent of the stacks of discs, to a second position, wherein the arms each extend into a respective one of the spaces formed between the discs of two stacks by the presence therebetween of the discs of the other stack, to push the yarn between the discs of the two stacks into the helical path formed between the discs. Such devices, known as threading gates, have been disclosed in many patent specifications and have been manufactured for many years. In all such cases the gate is arranged whereby all of the arms act on the yarn simultaneously. In DE-OS 2824034 of FAG the arms act on the yarn substantially simultaneously, but the arms are of different lengths.

The known apparatus mentioned hereinbefore, which comprises thicker discs than conventional apparatus, has presented particular problems in threading. This is because of its substantially improved twisting efficiency, and it is an object of the present invention to provide a false twisting apparatus of the kind referred to with a threading device which does not result in an unacceptably high tension peak, and thus suitable for this known apparatus, and also for apparatus of the kind referred to employing other high twist efficiency discs, such as discs of, or having rims of, polyurethane or other high disc-to-yarn co-efficient of friction materials.

According to the present invention there is provided, in or for apparatus of the kind referred to, a threading device comprising a plurality of yarn engaging tines, each movable from a first position outside the extent of the series of discs to a second position within a space between consecutive discs on two shafts as separated by a disc on the third shaft, at least some of the tines being movable into their respective second positions before the remaining tines, whereby the apparatus can be threaded in sequential stages.

The invention may also comprise means operable to increase the tension in a yarn being fed to the apparatus during said threading stages.

The invention will be further apparent from the following description with reference to the several Figures of the accompanying drawings, which show, by way of example only one apparatus of the kind referred to equipped with one form of yarn threading device embodying the invention.

Figure 1:
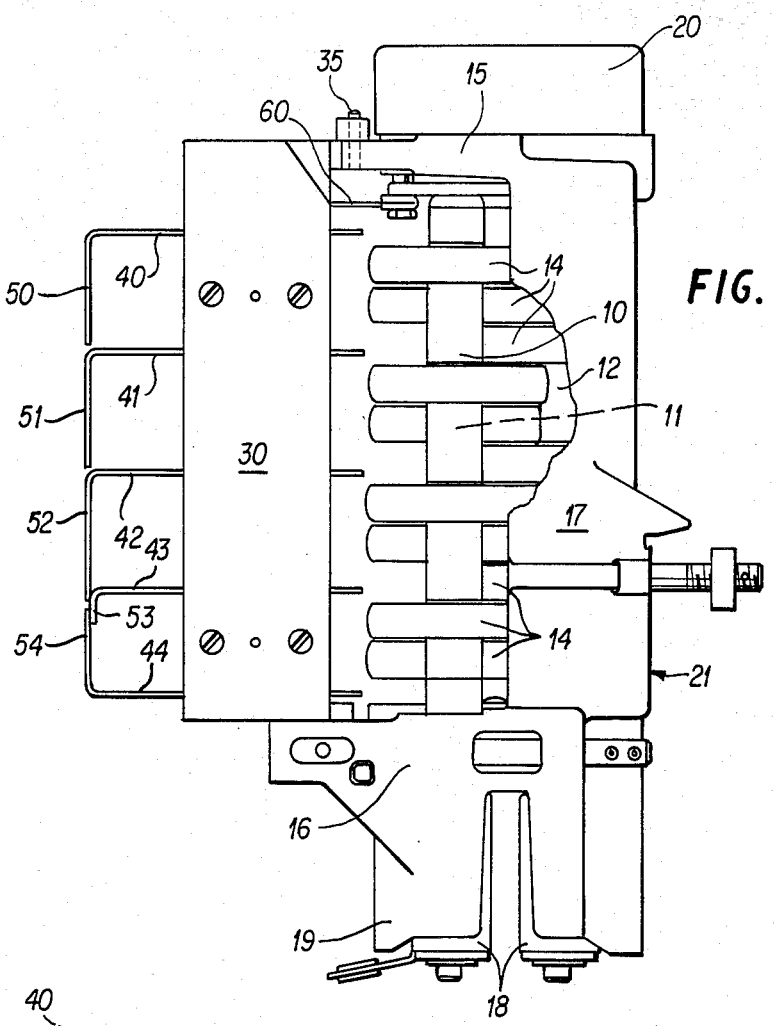
FIG. 1 is a schematic partly cut-away side view of a false twisting apparatus showing the threading device in the threading position.
Figure 2:
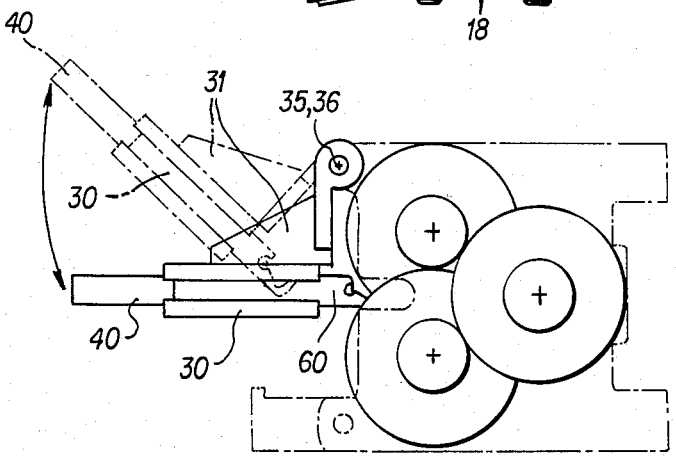
FIG. 2 is a schematic plan view of the false twisting apparatus of FIG. 1 with the threading device in its threading position.

The false twisting apparatus 21 itself, which is mounted (in known manner) downstream of a yarn heater (not shown) and yarn cooling zone (not shown) comprises three shafts 10,11 and 12 which are arranged at the apices of an equilaterial triangle with the shaft 11 hidden behind the shaft 10 in the view of FIG. 1. Each of the shafts 10,11 and 12 as shown carries four discs 14 which, as is well known, are interspaced so that the discs overlap to form a stack which lies on a helix around a central axis of the apparatus, as shown in FIG. 2.

Each disc 14 in the embodiment shown is of curved cross-section, for example, semi-circular or hyperbolic at its periphery and has an axial thickness substantially greater than discs previously proposed, and typically 12 mms although the device is not limited for use with such thicker discs. For example the discs 14 may be of, or have rims of polyurethane or like material having a high coefficient of friction with the yarn, thereby providing a high twisting efficiency. As shown the thickness and diameter of each disc are the same and the diameter is chosen to provide the designed over-lap as can be calculated according to known principles. Alternatively the disc thickness and/or diameters may differ within each disc stack.

Reduced numbers of discs can be used by removing some of the discs shown and replacing them with spacers. In practical use, guide discs of smoother material may be arranged as the first and last discs in the stack. For the most difficult twisting application of heavy denier polyester or polyamide, and using intervening or twisting discs of a ceramic coated material, typical arrangements are 1-4-1,1-7-1,0-9-0,1-10-1, 0-12-0 (where the first digit of each triplet indicates the number of input guide discs, the second digit the number of working or twisting discs and the last digit the number of output guide discs) using discs lying between 10 and 20 mms axial thickness. Using polyurethane discs typical arrangements are 1-4-1, or 1-7-1. It is clear, however, that the shafts of the present device are of sufficient length to receive at least four discs per shaft or a total of twelve discs of 10 mm thickness and preferably twelve discs of 12 mms or even 16 mms thickness to give sufficient room to receive the desired maximum number of discs.

Because of this extreme length of shaft in comparison with most previous devices of this type, each shaft is supported at both ends by respective bearings as opposed to the more usual cantilever arrangements. The bearings in turn are carried in housings 15 and 16 with the housing 15 connected to the housing 16 by an interconnecting part 17. One end of one of each of the shafts 10 and 12 carries a wharve 18 for engagement with a machine drive belt. A skirt 19 extends downwardly from the housing 16 to guard the wharves 18.

The ends of the shafts 10,11 12 opposite the wharves 18 are inter-connected by a timing belt drive (not shown).

The timing belt drive is entirely enclosed by a cup-shaped cover 20 which extends over the pulleys and belt and is attached onto a base plate secured to the housing 15. In this way the timing belt and pulleys are protected from the entrance of "snow" and other extraneous matter which can otherwise pack the teeth of the pulleys and prevent proper operation of the drive.

The threading device 13 comprises an elongate body 30 carried between upper and lower extended bracket members 31 and 32 respectively. The upper and lower bracket members 31 and 32 are provided with axially aligned bores 33 and 34 adapted to engage upstanding pins 35 and 36 of the false twisting apparatus, whereby the device may be readily located on and removed from any one such apparatus by simple manual lifting and lowering operation. This feature enables a single threading device 13 to be provided to service a multiplicity of false twisting devices—all such devices being incorporated on a single machine.

When the threading device 13 is located on one such false twisting apparatus 21 it may be swung (by pivotal movement about the axis between the pins 35 and 36) between a stand-off position, shown in chain-dotted lines in FIG. 2, and an operative position shown in full lines in both FIGS. 1 and 2.

Figure 3:
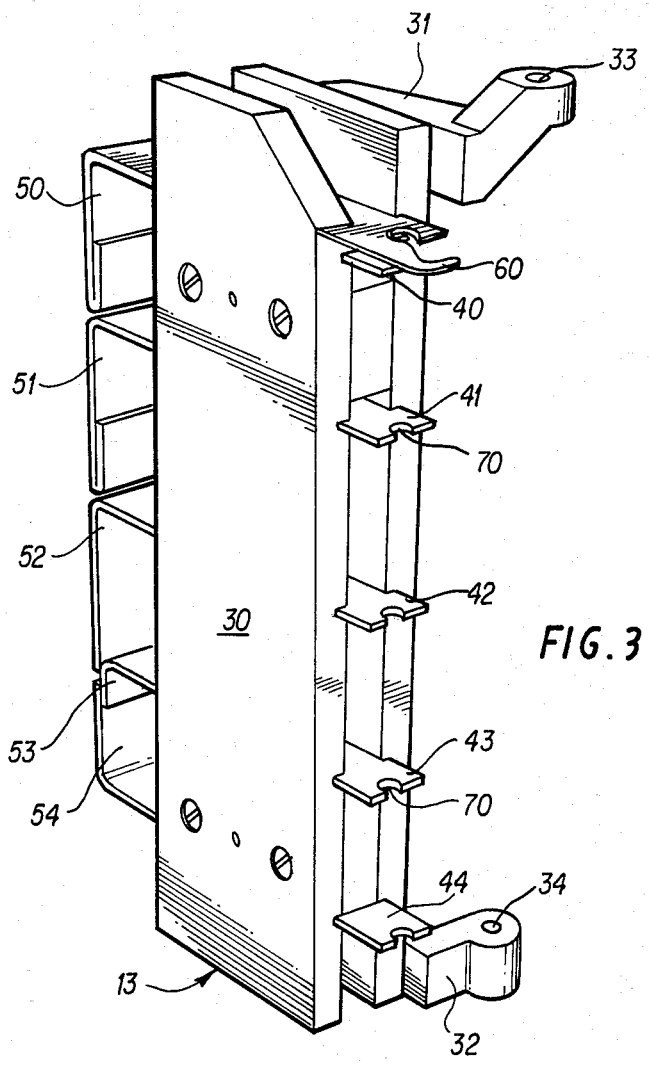
FIG. 3 is a perspective view of the threading device separated from the false twisting apparatus.

As best seen from FIGS. 1 and 3, the body 30 has, in this example, five apertures spaced along its length therethrough, in each of which is slidably mounted a yarn engaging tine. These tines are referenced 40,41,42,43 and 44 from the input to output ends of the apparatus 21 respectively. The tines 40 to 44 are biassed by springs (not shown) to the positions shown in full lines in FIG. 1, but may be pushed manually, against the action of such spring means, inwardly from positions outside the extent of the series of discs 14 on the shafts 10,11 and 12 to positions wherein their inner ends, which carry ceramic yarn engaging forks 70, are located within the respective spaces between consecutive discs 14 on the shafts 10 and 11 as separated by discs 14 on the shaft 12.

Each of the tines 40 to 44 has, on the side of the elongate body 30 remote from the discs 14, a manually pushable surface 50 to 54 respectively, (to move the tines to their inner positions). However, as best seen from FIGS. 1 and 3 the surfaces 52 and 54 each outwardly overlay the surface 53, whereby inward movement of either the surface 54 or 52 causes simultaneous inward movement of the tines 43 and 44 or the tines 43 and 42, respectively.

The threading device 13 carries a yarn input guide 60.

In use the operator, having located the threading device 13 in the stand-off position on one false twist apparatus 21 to be threaded, and drawn an end of yarn from a feed creel (not shown) to a feed system (not shown) positioned immediately downstream of the false twist apparatus 21, positions the yarn in the input guide 60, engages an intermediate yarn feed (not shown), swings the threading device 13 to its operative position, engages an input feed (not shown) and threads the lower discs 14 (nearer the output end of device 13) by pressing surfaces 54 and 52 in turn to move firstly tines 43 and 44 and then secondly tine 42 to their inner positions. At this stage the apparatus 21 is operating at low twist. The yarn is then engaged with the heater (not shown). The heated yarn stabilises and permits threading of the remaining discs by pressing surface 51 to move tine 41 to its inner position (1-7-1 configuration) or surfaces 51 and 50 in sequence to move tines 41 and 40 in turn to their inner positions (1-10-1 configuration).

Figure 4:
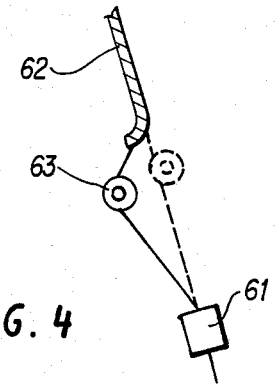
FIG. 4 is a schematic side view of one embodiment of thread tension increasing means.

FIG. 4 shows a false twist device 61 at the exit end of a yarn cooling plate 62. A capstan roller 63 is interposed between the plate 62 and the device 61 and is movable between a start-up positon as shown in solid line and a running position as shown in broken line. The effect of moving such capstan roller 63 to its start-up position is to increase yarn tension at the device 61 (and possibly to reduce tension over the plate 62) and this has been found to have a beneficial effect during the start-up procedure described above. In its running position, the capstan roller 63 acts as a guide to secure the yarn path over the plate 62.

The movement of the guide 63 could, if desired, be automatically synchronised with the operation of moving one of the tines of device 13, for example 41 or 40, to its inner operative position.

The deflection of the thread path by operation of the capstan roller 63 has been exaggerated in the drawing—in practice, it will not be such as would substantially affect the path of the yarn through the device 61.

Because the threading of the apparatus is effected in sequential stages, there is no unacceptably high tension peak during the threading operation.

It will be appreciated that it is not intended to limit the invention to the above example only, many variations, such as might readily occur to one skilled in the art, being possible without departing from the scope thereof.

We claim:

1. In an apparatus for false twisting yarn comprising three rotatable, parallel shafts arranged at the apices of an equilateral triangle, a plurality of mutually parallel coaxial discs forming a disc stack carried by each shaft and said discs being arranged on a helix around a central axis parallel with said shafts with consecutive discs on two shafts being separated by a space and a disc on the third shaft being disposed in said space; a threading device comprising a body secured in said apparatus to extend substantially in parallel with said axis and having a plurality of yarn engaging tines mounted thereon and spaced longitudinally thereof, each tine being movable relative to said body from a respective first position outside the extent of said plurality of discs to a respective second position within the said space, at least some of said tines being movable independently of the remaining ones of said tines.

2. A threading device according to claim 1 wherein said remaining tines are movable to their respective second positions independently of each other.

3. A threading device according to claim 1 wherein at least one of said some tines is adapted to effect movement of an adjacent tine towards its respective second position simultaneously with the movement of said one tine.

4. A threading device according to claim 1 wherein said body has said tines mounted therein, so as to be slidable transversely thereof.

5. A threading device according to claim 4 wherein said body is mounted in said apparatus so as to be pivotal between an operative position in which said tines are movable into and out of said space, and an inoperative position in which said tines lie entirely outside the extent of said plurality of discs in any position of movement thereof relative to said body.

6. A threading device according to claim 5 wherein said apparatus comprises upstanding pivot pins and said body is mounted on said pivot pins, whereby said threading device may be removed from and replaced on said pins.

7. A threading device according to claim 1 comprising biassing means wherein each of said tines is resiliently biassed towards its respective first position.

8. A threading device according to claim 1 comprising an input guide, wherein said body has said input guide mounted thereon.

9. A threading device according to claim 1 and tensioning means operable to increase the tension in a yarn being fed to said apparatus during a threading stage.

10. A threading device and tensioning means according to claim 9 wherein a yarn being fed to said apparatus traverses a yarn path and said tensioning means comprises a capstan roller mounted for displacement laterally of said yarn path between start-up and running positions.

11. A threading device and tensioning means according to claim 10 comprising means operable to effect movement of said roller from said start-up position to said running position simultaneously with movement of one of said remaining tines to its respective second position.

12. A threading device and tensioning means according to claim 9 and a cooling plate, wherein said tensioning means is located between said cooling plate and said apparatus.

13. A yarn texturing machine comprising a threading device according to claim 1.

14. For use with false twisting apparatus of the kind comprising three rotatable parallel shafts arranged at the apices of a triangle and having a plurality of parallel discs on each shaft which interdigitate with the discs on the other two shafts, a threading device comprising a plurality of yarn engaging tines each of which is movable from an inoperative position outside the extent of the series of discs to an operative position in which it extends into a space between consecutive discs on two of the shafts as separated by a disc on the third shaft, at least some of the tines being movable into their operative positions independently of the other tines, whereby, during use of the threading device, a false twisting apparatus with which the device is being used can be threaded in sequential stages.

15. A threading device as recited in claim 14 wherein at least two of the tines are interconnected so that movement of one of them to its operative position causes simultaneous movement of the other of them to its operative position.

16. A threading device as recited in claim 14 and further comprising an elongate body in which the tines are slidably mounted.

17. A threading device as recited in claim 16 wherein the tines are mounted in space disposition longitudinally of the elongate body and slide transversely of the elongate body.

18. A threading device as recited in claim 17 and further comprising first means for mounting the elongate body on false twisting apparatus so that the elongate body is pivotable between an operative position in which each of the tines is movable into the corresponding space between the discs and an inoperative position in which the tines extend outside the extent of the series of discs in any position of movement of the tines relative to the elongate body.

19. A threading device as recited in claim 18 wherein said first means comprise axially aligned bores in the elongate body sized, shaped, and positioned to receive upstanding pivot pins on false twisting apparatus, whereby the threading device can be easily removed from the pivot pins of one false twisting apparatus and replaced on the pivot pins of another false twisting apparatus.

20. A threading device as recited in claim 16 and further comprising an input guide mounted on the elongate body.

21. A threading device as recited in claim 14 wherein the tines are resiliently biased towards their inoperative positions.

22. A threading device as recited in claim 14 and further comprising second means for increasing the tension in yarn being fed to false twisting apparatus while the false twisting apparatus is being threaded.

23. A threading device as recited in claim 22 wherein said second means comprise a capstan roller mounted for displacement laterally of the yarn path to the false twisting apparatus between start-up and running positions.

24. A threading device as recited in claim 23 and further comprising third means for effecting movement of the capstan roller from its start-up position to its running position simultaneously with movement of one of the tines to its operative position.

25. A threading device as recited in any of claims 22–24 wherein said second means is located between a cooling plate and the false twisting apparatus.

* * * * *